US005143287A

United States Patent [19]

Jardinier

[11] Patent Number: 5,143,287

[45] Date of Patent: Sep. 1, 1992

[54] CONTROL DEVICE FOR A SYSTEM REGULATING THE VENTILATION FLOW OF A CONTROLLED-ATMOSPHERE ROOM, AND FUNCTIONING CYCLES THEREOF

[75] Inventor: Pierre Jardinier, Gournay S/Marne, France

[73] Assignee: Societe d'Etude et de Recherche en Ventilation et Aeraulique S.E.R.V.A., France

[21] Appl. No.: 606,931

[22] Filed: Oct. 31, 1990

[30] Foreign Application Priority Data

Nov. 6, 1989 [FR] France ..... 8914752

[51] Int. Cl.[5] ..... F24F 13/10

[52] U.S. Cl. ..... 236/493; 236/68 R; 251/11; 251/30.05

[58] Field of Search ..... 251/11, 30.01, 30.05; 137/625.65; 236/49.3, 49.4, 68 R

[56] References Cited

U.S. PATENT DOCUMENTS

| | | | |
|---|---|---|---|
| 2,983,285 | 5/1961 | Gardner | 137/625.65 |
| 3,460,573 | 8/1969 | Beveridge et al. | 137/625.65 |
| 4,114,645 | 9/1978 | Pauliukonis | 251/11 X |
| 4,184,634 | 1/1980 | Betts et al. | 236/68 R X |
| 4,211,363 | 7/1980 | Osheroff | 236/49.4 |
| 4,331,291 | 5/1982 | Dean | 236/49 |
| 4,356,963 | 11/1982 | Edwards et al. | 236/49.4 |
| 4,545,524 | 10/1985 | Zelczer | 236/46 R |
| 4,783,045 | 11/1988 | Tartaglino | 251/61.1 |
| 4,890,790 | 1/1990 | Wagner | 251/11 X |

FOREIGN PATENT DOCUMENTS 3223424 12/1983 Fed. Rep. of Germany .

*Primary Examiner*—William E. Tapolcai
*Attorney, Agent, or Firm*—Oliff & Berridge

[57] ABSTRACT

The invention relates to a control device for a system for regulating the ventilation of a controlled-atmosphere room. The system has at least one sensor located in the room to pick up desired information such as temperature, humidity, carbon dioxide level, or other similar levels, or occupancy or nonoccupancy of the room. A valve, of the deformable bladder type, is located in the ventilation duct of the room and the system is controlled by the control pressure of the valve as a function of information picked up by the sensor. This control device has, in combination, a pressure divider designed to deliver the control pressure of the valve based on the different pressures of pressure sources to which it is connected, two capsules deformable in accordance with instruction signals received and acting on a movable element of the pressure divider with reverse effects to cause the control pressure to vary as a function of the aforesaid instructions, power supply means for changing the internal pressure in the capsules as a function of the instructions received, means associated with the capsules providing independence from the effects of variation in atmospheric pressure, and a control element for the power supply means that is able to receive a signal emitted by the sensor and, in a predetermined cycle, composed of a series of powering and relaxation periods of the two capsules, to emit a signal controlling control pressure P3.

13 Claims, 5 Drawing Sheets

$P_3 = \frac{3}{4}(P_1 - P_2)$

CONTROL DEVICE FOR A SYSTEM REGULATING THE VENTILATION FLOW OF A CONTROLLED-ATMOSPHERE ROOM, AND FUNCTIONING CYCLES THEREOF

TECHNICAL FIELD

The present invention relates to a control device for a system regulating the ventilation flow of a controlled-atmosphere room, allowing the ventilation flow to be modulated as a function of an electrical signal coming in particular from sensors that evaluate the actual requirements in each room.

BACKGROUND

In carrying out this type of regulation, it is usual to employ techniques utilizing a motor-actuated check valve or other type of valve. Such a solution has the disadvantage of being cumbersome and requiring high power for operation.

To overcome these drawbacks, the use of a supplementary high-pressure system to activate pneumatic valves is known. However, such devices in current use do not allow the energy of the air valve to be used to regulate the flow.

As a result, there is a significant energy loss in a complete regulating system that allows the air to be distributed properly where required.

SUMMARY OF THE INVENTION

A goal of the present invention is to overcome these disadvantages by furnishing a control device and an operating cycle which allow the ventilation of a controlled-atmosphere room to be regulated as desired, which are easy to produce, and which can be used under all circumstances.

For this purpose, the invention relates to a control device for a system for regulating the ventilation of a controlled-atmosphere room. The system has at least one sensor located in the room to pick up desired information such as temperature, humidity, carbon dioxide level, or other similar levels, or occupancy or nonoccupancy of the room. A valve, of the deformable bladder type, is located in the ventilation duct of the room and the system is controlled by the control pressure of the valve as a function of information picked up by the sensor. This control device has, in combination, a pressure divider designed to deliver the control pressure of the valve based on the different pressures of pressure sources to which it is connected, two capsules deformable in accordance with instruction signals received and acting on a movable element of the pressure divider with reverse effects to cause the control pressure to vary as a function of the aforesaid instructions, power supply means for changing the internal pressure in the capsules as a function of the instructions received, means associated with the capsules providing independence from the effects of variation in atmospheric pressure, and a control element for the power supply means that is able to receive a signal emitted by the sensor and, in a predetermined cycle, composed of a series of powering and relaxation periods of the two capsules, to emit a signal controlling control pressure P3.

BRIEF DESCRIPTION OF THE DRAWINGS

The invention will be thoroughly understood with the aid of the description hereinbelow which refers to the attached schematic diagrams showing, as nonlimiting examples, one embodiment of this device and illustrating two operating modes.

DETAILED DESCRIPTION OF PREFERRED EMBODIMENTS

Figure 1:
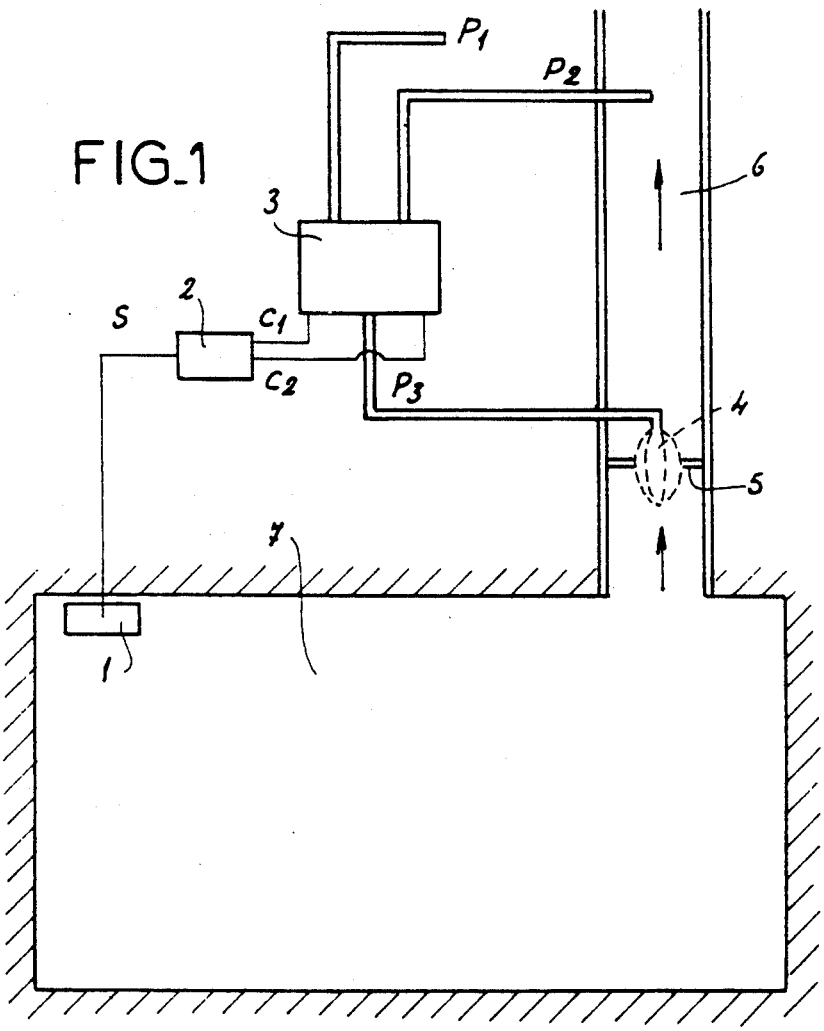
FIG. 1 is a view of the regulating system using the device of the invention.

According to one embodiment of the invention, the device operates by referring to two pressure sources P1, P2. One of them, P2, which is that prevailing in the pipe leading to the room, is the higher pressure while the other, P1, which is the ambient pressure, constitutes the lower pressure.

The pressure divider of this device has a body having two inlet orifices, each of which is connected to one of the aforesaid pressure sources, and an outlet orifice connected to the valve-control orifice. Between the inlet orifices and outlet orifice is a movable element, such as a core or slide which is axially movable, allowing the mixing ratio of the inlet pressures to be changed, thus determining the outlet pressure or control pressure.

According to a preferred embodiment of the invention, each deformable capsule is composed of a body in the form of a closed envelope, one wall part of which is elastically movable in the direction of movement of the movable element of the pressure divider, in order to displace it to the position determined by the instruction signal received by this capsule from the control element.

Advantageously, the envelope has a small volume, and its elastically movable wall part is composed of a deformable membrane, which may or may not be connected, and which consumes only a small amount of deformation energy.

According to one useful feature of the invention, the wall of one of the capsules has a lesser thickness than that of the other capsule.

This allows for operation requiring minimum consumption of energy.

According to another feature of the invention, the two capsules are connected to the outside air by a calibrated passage of the controlled microleak type such that the quantities of air that could escape during the capsule powering periods are negligible.

Such a leak allows the internal pressure of the capsule to be equalized with the ambient pressure, taking a fairly long time relative to the lengths of the various control cycle sequences, thus providing independence from variations in atmospheric pressure.

In fact, natural barometric variations are always slow, and equalization may thus occur through the leak, which allows correct operation of the control system whatever the meteorological conditions and altitudes where it is used.

According to a preferred embodiment of the invention, the means that move the movable wall part of each capsule in the direction of the movable element of the pressure divider are comprised of a heating element of the resistive type whose temperature increases as a function of the electrical current applied, which has the effect of increasing the internal pressure of this capsule and pushing back its movable wall part. This capsule design is advantageous because, inter alia, the heating elements may be supplied with a power of 1 watt, which is a very low energy consumption.

Advantageously, the control element allows the following: capsule powering periods are started; a succession of capsule powering periods is programmed; a powering period of one of the two capsules is selected, which capsule must, by its action on the movable element of the pressure divider, cause the valve to open as a function of signals coming from the sensor, which have been collected during the relaxation period; and the power to be supplied to this capsule is defined for this period as a function of the signals coming from the sensor during this relaxation period.

In this way, this control device allows the ventilation flow rates to be modulated according to the actual requirements in each room.

This control element for the power supply means allows capsule powering periods to be started, the lengths of which are limited to the time necessary for the deformations in said capsules practically to reach a state of equilibrium.

Moreover, it allows a succession of these powering phases to be programmed by interspersing them with (generally longer) phases of capsule relaxation, the durations of which may be fixed or may depend on changes in the information picked up by the sensor.

For a given powering phase, this control element actuates the capsule which must, by its action on the pressure divider, determine the opening of the valve as a function of signals coming from the sensor during the last relaxation phase or phases.

Finally, for a given powering phase, it determines the power to be supplied to the corresponding capsule as a function of signals coming from the sensor during the last relaxation phase or phases.

According to one embodiment of the invention, the pickup sensor located in the room is an infrared sensor. This sensor allows the occupancy or nonoccupancy of the room to be detected.

Advantageously, the means for supplying the two capsules with power constitute at least one electric battery.

The means for supplying power to the two capsules have a variable power in order to permit, after a certain threshold, only displacement of the thinner wall of these two capsules.

Thus the device can quite safely regulate the atmosphere of the room. In cases where the power supply means allows the heating elements to be powered for only one of the two capsules, they bring the pressure divider into a position such that the connected pipe with the higher pressure is blocked. In this way, the bladder is subjected to the lower pressure and the air flow is at a maximum.

Advantageously, the movable element of the pressure divider is associated with a brake designed to eliminate any unwanted continuation of its travel.

This brake in particular allows the position of the movable element to be maintained by making it independent of the inclination of the device and the influence of any source of vibration that could change the regulation.

According to another useful characteristic of the invention, the control pressure outlet pipe has a choke with a conical shape.

This choke allows any pumping phenomena to be limited and thus the quality of regulation to be improved.

According to a first embodiment of this device, its operating cycle, the total duration of which is several minutes, comprises four periods.

In a first period, the control element emits an instruction signal transmitted to the first capsule, i.e. to the capsule whose function is to return the movable element of the pressure divider to its original position, so that the inlet orifice connected to the higher pressure source communicates with the outlet orifice furnishing the control pressure of the valve, while the other inlet orifice is blocked, with the other capsule receiving no signal.

A second period is provided to allow both capsules to relax, neither receiving an instruction signal, with the movable element of the pressure divider remaining in position.

In a third period, each sensor emits an information signal transmitted to the control element which itself emits a control signal transmitted to the second capsule, the function of which capsule is to displace the movable element of the pressure divider in the reverse direction, on a path determined by the information delivered by the detection sensor, in order to obtain an appropriate mixture of the two pressures supplying the control pressure of the valve corresponding to the requirement of the room, with the other capsule receiving no signal.

A fourth period, whose duration is over 50% of the duration of the entire cycle, is provided to allow both capsules to relax, neither receiving an instruction signal, so that the movable element of the pressure divider retains the same position as in the previous period, and the cycle recommences.

Advantageously, the fourth period is the longest of the cycle in order to preserve the low energy consumption to the greatest degree possible. It should be noted that the bladder inflated by the control pressure remains in the same position during this entire fourth period, which favors overall equilibrium of the system and prevents any pumping phenomena.

According to another embodiment of this device, its operating cycle has the following three periods.

In a first period, the control element emits an instruction signal transmitted to the capsule whose function is to displace the movable element of the pressure divider to a position determined by the control information emitted by each pickup sensor in the room, to obtain an output pressure of the valve that is appropriate to the ventilation requirement of the room, while the other capsule receives no instruction signal.

A second period is provided for relaxation of the two capsules, neither receiving an instruction signal, while the movable element of the pressure divider retains its position.

In a third period, the value of the signal emitted by the detection sensor in the room is compared to that of the preceding measurement. If the ventilation requirement is greater, the control element emits an instruction signal transmitted to the capsule designed to displace the pressure divider such that the inlet orifice connected to the lower-pressure source communicates more broadly with the outlet orifice. This furnishes a valve-control pressure that is closer to the lower pressure. The bladder is in this way subjected to a pressure closer to P1 such that its volume decreases and the air flow increases. If, on the contrary, the ventilation requirement detected by the sensor in the room is lower, the control element emits an instruction signal transmitted to the other capsule such that the movable element of the pressure divider is moved in the reverse direction. The inlet orifice connected to the higher-pressure source then communicates more broadly with the outlet orifice in order to supply a valve-control pressure that is closer to the higher pressure. The bladder is in this way subjected to a pressure closer to P2 such that its volume increases and the air flow decreases.

This method of operation eliminates the systematic dropping to the lower pressure during the first and second periods of the preceding cycle, which increases the stability of the pressures in the ventilation systems and eliminates the need for a choke in the valve-control pressure outlet pipe.

This method of regulation is particularly suitable for ventilation, since the concentration of contaminants always changes at fairly slow rates, and a very rapid control cycle is neither necessary nor desirable for the overall stability of large systems.

Advantageously, the control element of the heating elements is designed to make comparisons between several signals coming from various sensors located in the room, and to make priority determinations before creating the instruction signal transmitted to the capsules.

According to another embodiment of this device, its operating cycle comprises two periods.

A first period starts as soon as the sensor detects a presence, while the bladder is at a maximum volume and the ventilation flow is minimal, by emission of an instruction signal C2 from the control element transmitted to capsule B designed to displace the pressure divider in a direction such that the inlet orifice connected to pressure source P1 communicates with the outlet orifice, the other inlet orifice connected to pressure P2 being blocked. This furnishes a bladder control pressure P3 corresponding to pressure P1 and its minimum volume, which corresponds to a maximum air flow. This period continues with its status maintained for as long as the presence detection signals occur at time intervals of less than a predetermined duration.

A second period starts when the sensor has not detected a presence during the aforementioned time interval of predetermined length, while the bladder has a minimum volume and a maximum air flow, by emission of an instruction signal C1 transmitted to capsule A from the control element connected to pressure source P1 such that the inlet orifice connected to pressure source P2 communicates with the outlet orifice, while the orifice connected to pressure P1 is blocked. In this way, a bladder control pressure P3 is furnished. The bladder is then subjected to pressure P2, its volume being maximal and the air flow minimal. This period continues with its status maintained for as long as a presence is not detected.

In this way, the device operates in an "all or nothing" cycle which expands its possible applications. Moreover, according to this embodiment, it is used to control the ventilation flow regulation of the controlled-atmosphere room in the case where the room is occupied.

This allows the movable element of the pressure divider to occupy only two positions corresponding to maximum air flow and minimum air flow.

This decreases the large consumption of energy by allowing the movable element of the pressure divider to remain in a single position which is selected depending on whether the room is occupied by a person.

FIG. 1 depicts a regulating system using the control device of the invention.

A ventilation requirement detection sensor 1 is located in a room 7. Signals S coming from this sensor are routed, by an appropriate means, to control element 2 which converts them into instructions C1 and C2. C1 is a reference instruction value, i.e. independent of the ventilation requirement, which allows the control device to be reset to the original setting. C2 is an instruction value that depends on the ventilation requirement of the controlled-atmosphere room and which allows the control system to furnish a response appropriate to the needs.

The air flows from duct 6 to the room to be ventilated, as shown by the arrows in this figure.

Control device 3 receives, by known signal transmission means, instructions C1 and C2 coming from control element 2, and communicates via two pipes with two different pressure sources P1, P2. One of the pressures, P2, which is the higher pressure, is that prevailing in duct 6 that leads into room 7. The other, P1, which is the ambient pressure, constitutes the lower pressure. From this information, it creates a control pressure P3 injected directly into control element 4, which is a valve of the bladder type whose inflation is linked to the value of this control pressure P3. Valve 4 varies the size of the aperture for the air flowing through duct 6, leading into room 7, as a function of the control pressure. The presence of an annulus 5 with a specific geometry allows known flows to be associated with different values of P3.

Figure 2:
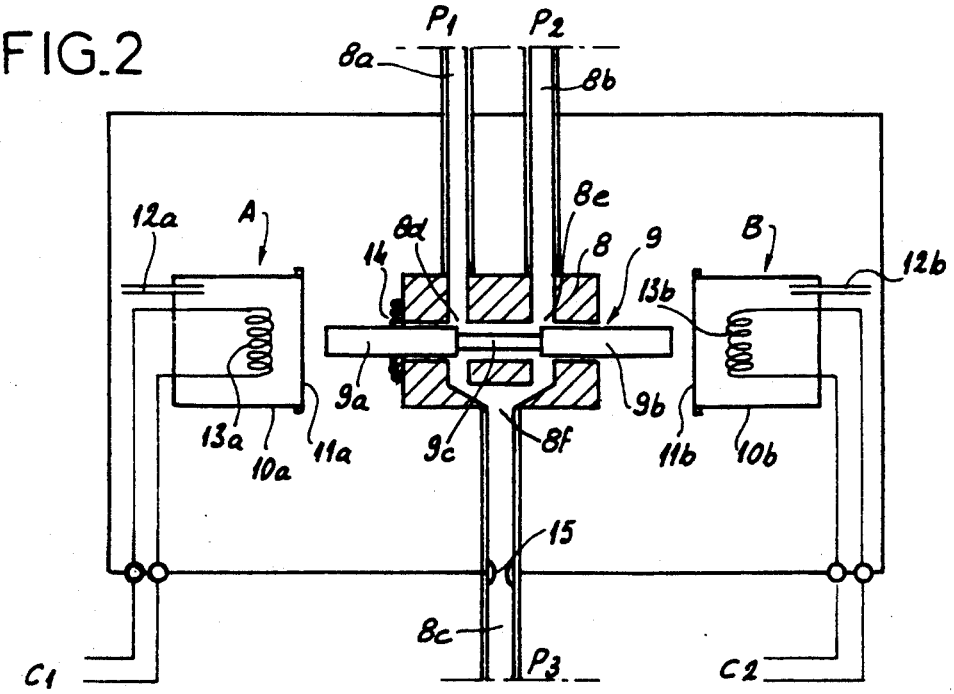
FIG. 2 is a cross section of the control device.

Control device 3, of which a cross-sectional view is shown in FIG. 2, processes and shapes the control signals; it generates the cycle of alternating deformations in capsules A and B.

As shown in FIG. 2, this control device 3 has a pressure divider 8 whose body has two inlet orifices 8*e* and 8*d*, each being connected to one of the aforementioned pressure sources, and an outlet orifice 8*f* connected to the control orifice of valve 4. Between inlet orifices 8*e* and 8*d* and outlet orifice 8*f* is an axially movable core or slide of the cylindrical piston type 9. This piston 9 is composed of two extensions 9*a* and 9*b* integral with a central element 9*c* which has a smaller diameter. Piston 9 changes the mixing ratio of the inlet pressures, which ratio determines the outlet pressure P3 or control pressure as a function of the positions of its ends relative to the inlet orifices of the aforesaid pressures.

Two capsules A and B are located on either side of the movable element. Each of them is comprised of a body 10*a* and 10*b* in the shape of a small-volume closed envelope. Wall parts 11*a*, 11*b* are elastically movable in the direction of movable element 9 of pressure divider 8 in order to move it into the position determined by instruction signal C1 or C2 received from control element 2. Each capsule A and B has a calibrated passage 12*a*, 12*b* with a small cross section constituting a controlled microleak which is connected to the outside. Each capsule also contains a resistive-type heating element 13*a*, 13*b* whose temperature increases as a function of the electrical current applied, with the effect of increasing the internal pressure of the respective capsule and pushing back movable wall part 11*a*, 11*b*. A brake 14 is placed on the outer part of at least one extension 9*a*, 9*b* of movable element 9 in order to prevent any unwanted continuation of its travel.

Output pipe 8*c* of control pressure P3 has a conical choke 15 which limits any pumping phenomena and limits the time required to reestablish control pressure P3.

A first application of this device is illustrated in FIGS. 3 to 10.

This first application has an operating cycle with a total length of several minutes that consists of four periods, T1, T2, T3, and T4.

Figure 3:
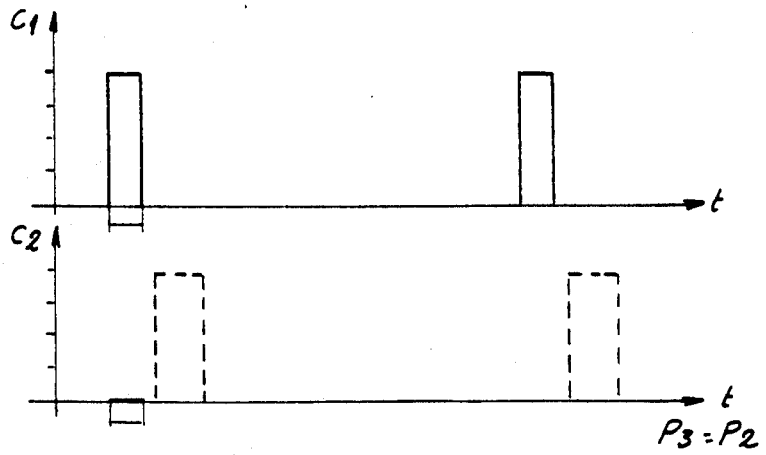
FIGS. 3 to 10 are views illustrating different stages in the operating cycle, according to a first application.
Figure 4:
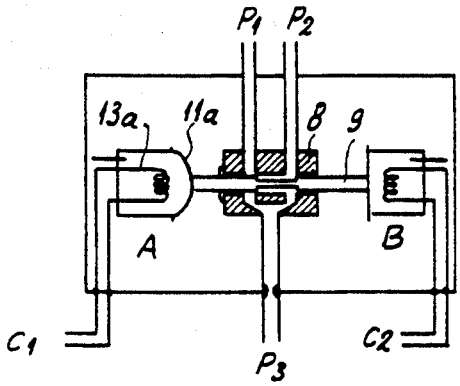

The purpose of the first, T1, illustrated in FIGS. 3 and 4, is to return movable element 9 of pressure divider 8 of control device 3 to its original position. An instruction C1 is provided to heating element 13*a* of capsule A. This instruction is held for a given time so that movable element 9 of pressure divider 8 is brought to the extreme position by the deformation of elastic zone 11*a*. As a result, the inlet orifice connected to the lower-pressure source, i.e. pressure P1, is blocked so that the inlet orifice connected to higher-pressure source P2 communicates fully with the outlet orifice of outlet pressure P3. Control pressure P3 is thus equal to pressure P2. Bladder 4 is in this way subjected to pressure P2 and its volume is maximal, which corresponds to a minimal air flow rate. The other capsule B receives no signal.

Figure 5:
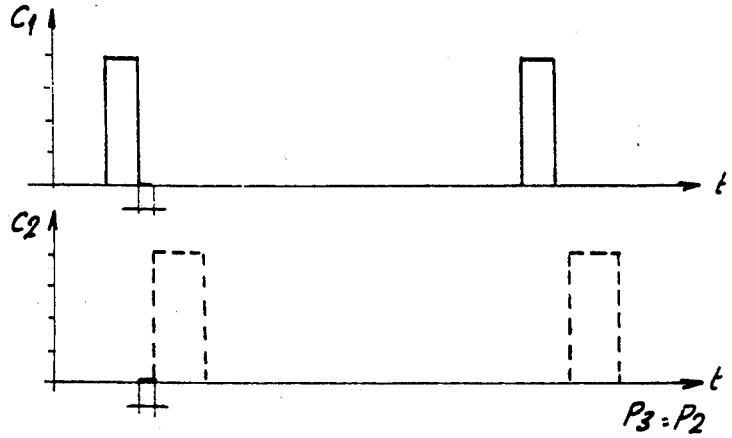
Figure 6:
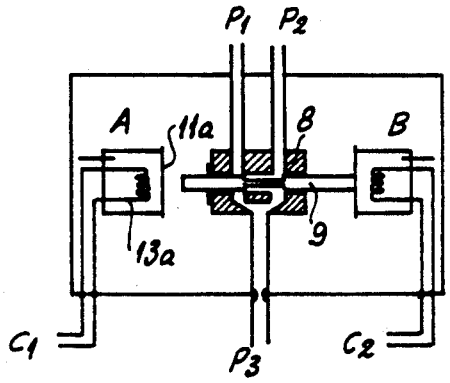

Second period T2, illustrated in FIGS. 5 and 6, is intended to allow deformed zone ll*a* to revert to its original status. Neither capsule receives an instruction signal, and movable element 9 of pressure divider 8 retains its position so that outlet pressure P3 remains equal to pressure P2.

Figure 7:
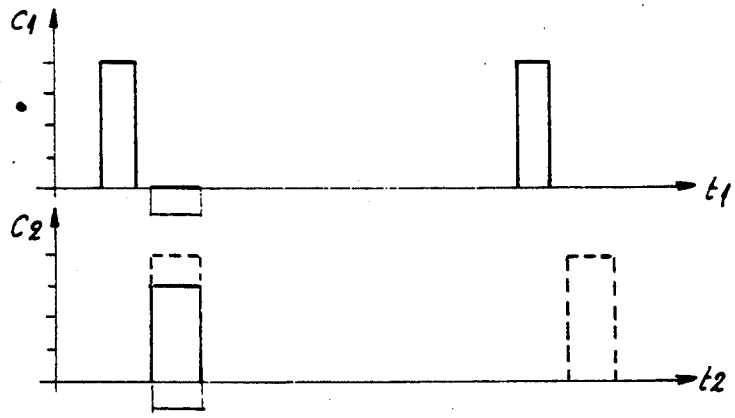
Figure 8:
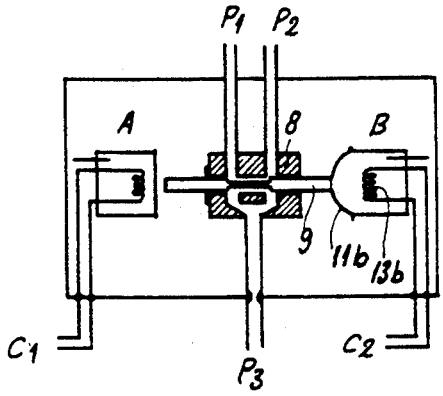

Third period T3, illustrated in FIGS. 7 and 8, is intended to place movable element 9 of pressure divider 8 in a position that depends on detection signal S emitted by source 1.

The information picked up by sensor 1 is transmitted to control element 2 which emits a control signal or instruction C2 to heating element 13*b* of second capsule B. This displaces movable element 9 of pressure divider 8 in the reverse direction to an extent determined by the value of instruction C2, thanks to the movement of elastic zone 11*b*. A control pressure is obtained by the resultant mixing of the two inlet pressures. The cycle shown can allow a control pressure value P3 equal to $\frac{3}{4}$ of the difference between pressures P1 and P2 to be associated with an instruction value equal to $\frac{3}{4}$ of the maximum instruction, and the response is hence linear over the entire regulation range.

Capsule B can be heated either for a time that varies according to information from detection sensor 1 with a constant power, or for a constant time with a power that varies according to the information from sensor 1.

Figure 9:
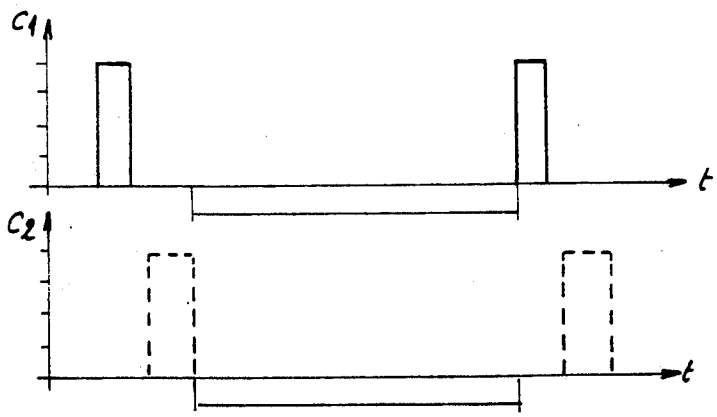
Figure 10:
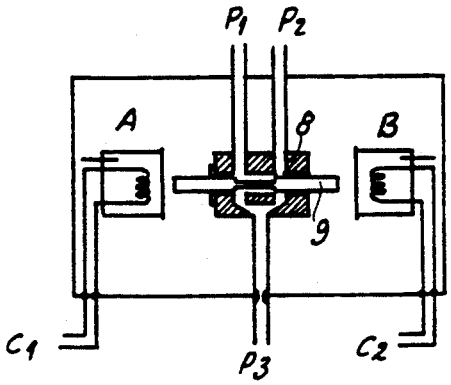

Fourth period T4 shown in FIGS. 9 and 10, which lasts over 50% of the total length of the cycle, is intended to keep movable element 9 of pressure divider 8 in its position determined by the previous period in order for control pressure P3 to remain equal to $\frac{3}{4}$ of (P1 - P2); during this period neither of the capsules receives an instruction signal.

Second capsule B thus resumes the non-deformed position, the elastic zone having stayed in position, in the same way as capsule A in the second period. This period is followed by period T1.

According to another embodiment of the invention, its operating cycle may be that illustrated in FIGS. 11 to 15.

This cycle has a total length of several minutes and, at the beginning, has three periods T1, T2, and T3 followed by a sequence of periods T2 and T3.

Figure 11:
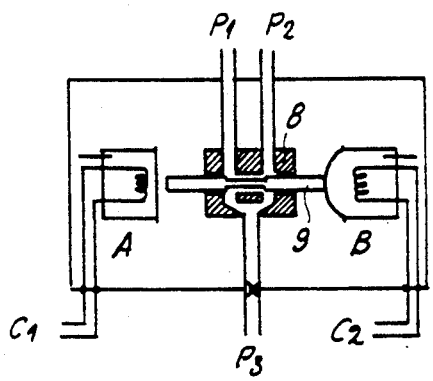
FIGS. 11 to 18 are views similar to FIGS. 3 to 10 illustrating different stages of its operating cycle, according to a second application.
Figure 12:
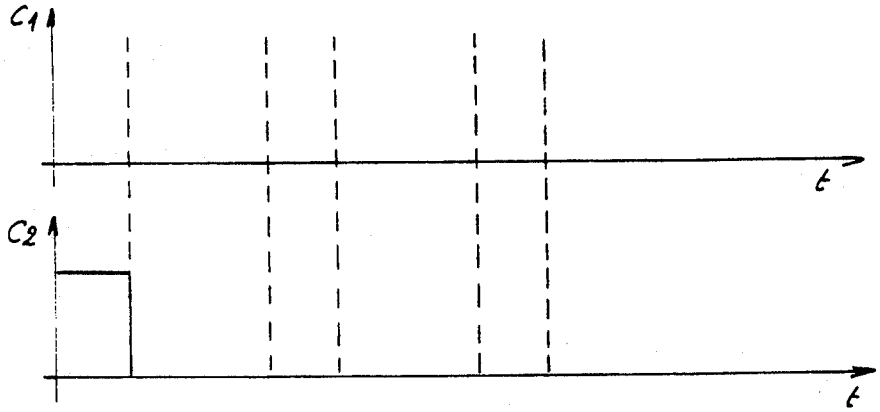

First period T1 is illustrated by FIGS. 11 and 12. During this period, control element 2 transmits an instruction C2, corresponding to the signal S emitted by sensor 1, to heating element 13*b* of capsule B. Elastic zone 11*b* deforms and causes displacement of movable element 9 of pressure divider 8 into a specific position defined by the control parameters in order to obtain a control pressure P3 of valve 4 that is appropriate to the ventilation requirements of room 7, with the other capsule A receiving no instruction signal.

Figure 13:
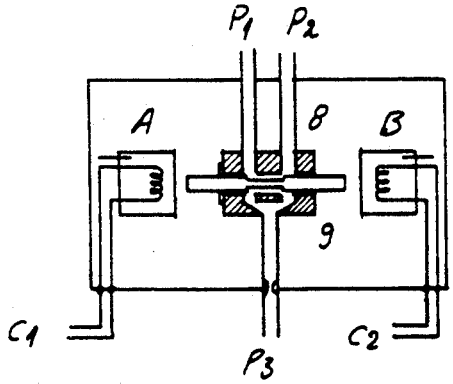
Figure 14:
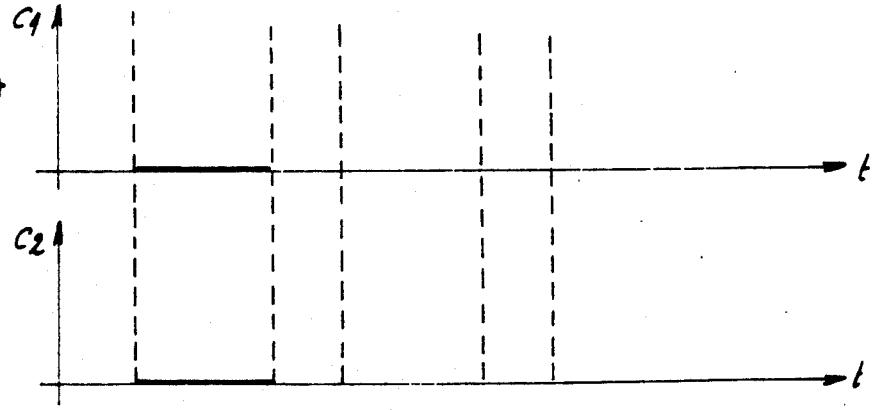

Second period T2 is illustrated by FIGS. 13 and 14. During this period, no capsule receives an instruction signal for a specific time, and movable element 9 of pressure divider 8 retains its position. Elastic zone 11*b* also resumes a nondeformed position, and control pressure P3 retains the same value as during the preceding period.

During third period T3, illustrated in FIGS. 15–18, the value of signal S of sensor 1 is compared to the value it had in the previous measurement.

Figure 15:
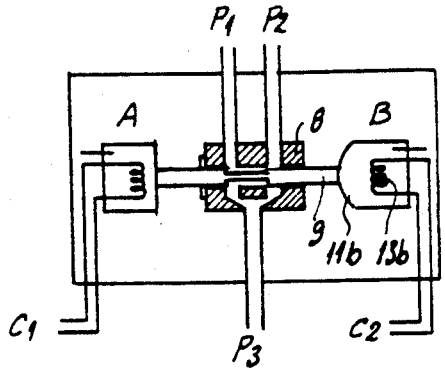
Figure 16:
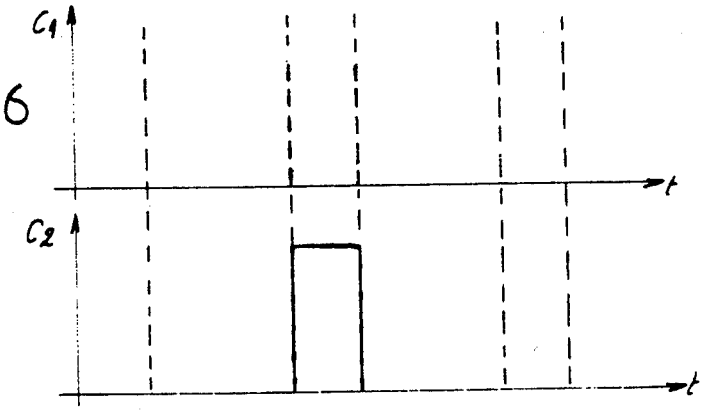

If the new measurement indicates a greater ventilation requirement, as shown in particular in FIGS. 15 and 16, control element 2 emits an instruction signal C2 intended to displace movable element 9 of pressure divider 8 as a result of the deformation of elastic zone ll*b* of capsule B. Inlet orifice 8*d* connected to lower-pressure source P1 communicates more broadly with outlet orifice 8*f*, thus supplying a control pressure P3 of valve 4 that is closer to lower pressure P1. In this way, bladder 4 is subjected to a pressure closer to P1, its volume decreases, and the air flow increases.

Figure 17:
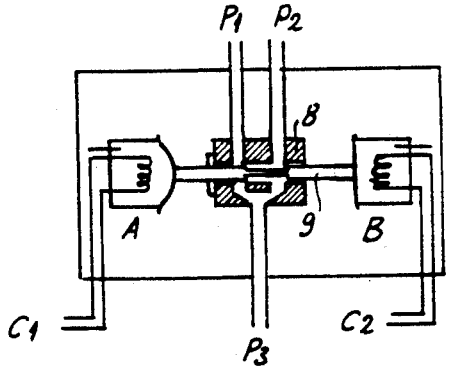
Figure 18:
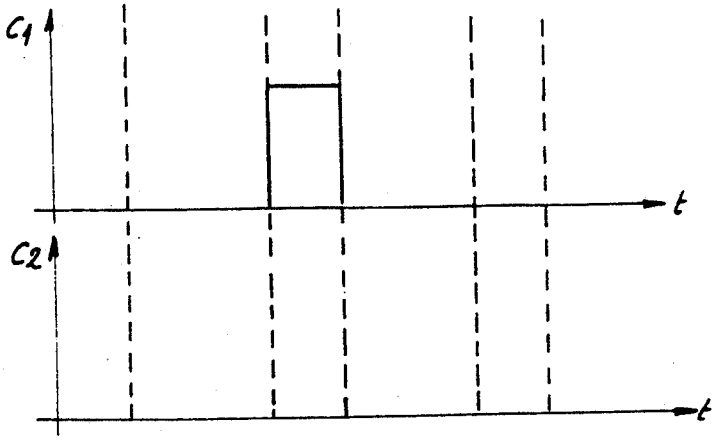

If, on the contrary, the new measurement indicates a lower ventilation requirement, as shown in FIGS. 17 and 18, an instruction C1 is transmitted by control element 2 to capsule A intended to displace movable element 9 of pressure divider 8 in the reverse direction as a result of the deformation of its elastic zone ll*a*. Inlet orifice 8*e* connected to higher-pressure sensor P2 then communicates more broadly with outlet orifice 8*f*, furnishing a control pressure P3 that is closer to P2. Bladder 4 is thus subjected to a pressure closer to P2, its volume increases, and the air flow decreases.

What is claimed is:

1. Control device for a system regulating the ventilation flow of a controlled-atmosphere room comprising at least one sensor located in the room to pick up desired information such as temperature, humidity, carbon dioxide level or other similar levels, or occupancy or nonoccupancy of the room, a deformable bladder type valve located in a ventilation duct of the room and controlled by a control pressure of said valve as a function of information picked up by the sensor, comprising, in combination, a pressure divider connected to two pressure sources for delivering the control pressure of the valve based on different pressures delivered by said two pressure sources and containing a movable element, deformable capsules located adjacent said movable element of said pressure divider and acting on said movable element to cause said control pressure to vary as a function of instruction signals, energy-supply means for changing the internal pressure in said capsules to deform said capsules as a function of the instruction signals, means for rendering said capsules independent from effects of variations in atmospheric pressure, and a control element of said energy supply means for receiving an information signal emitted by the sensor and for emitting, in a predetermined cycle composed of a series of powering and relaxation periods for the two capsules, said instruction signals for controlling said control pressure.

2. A device according to claim 1, wherein said each said deformable capsule is comprised of a body in the shape of a closed envelope, said closed envelope having a wall part which is elastically movable in the direction of said movable element to displace said movable element into a position determined by said instruction signals.

3. A device according to claim 2, wherein said wall part of a first said capsule has a lesser thickness than said wall part of a second said capsule.

4. A device according to claim 1, wherein each of said two capsules is connected to outside air by a calibrated passage of the controlled microleak type in such a way that quantities of air that can escape from said capsules during the powering periods are negligible.

5. A device according to claim 2, wherein said energy supply means is comprised of a resistive heating element, whose temperature increases as a function of electric current applied, for increasing internal pressure of said capsule and pushing back its movable wall part.

6. A device according to claim 1, wherein said control element is programmed to cause the following sequence of events: capsule powering periods are started; a succession of capsule powering periods is programmed; for a given powering period, that capsule is selected which must, by its action on said movable element of said pressure divider, cause said valve to open as a function of signals coming from the sensor which have been collected during a said relaxation period, power to be supplied to this capsule being defined for this period as a function of the signals coming from the sensor during said relaxation period.

7. A device according to claim 1, wherein the sensor is an infrared sensor.

8. A device according to claim 1, wherein said energy supply means comprises at least one electric battery.

9. A device according to claim 1, further comprising a brake associated with said movable element of said pressure divider for eliminating any unwanted continuation of travel.

10. A device according to claim 1, wherein said control pressure is delivered to said valve through an outlet pipe having a conical choke.

11. A device according to claim 1, wherein said cycle has a total duration of several minutes and is repetitive, and each repetition comprises the following four periods:

(a) a first period during which the control element transmits a said instruction signal to a first said capsule whose function is to return said movable element of said pressure divider to a starting position wherein a first inlet orifice connected to a first said pressure source communicates with an outlet orifice which furnishes said control pressure to said valve, said bladder being thus subjected to a pressure of said first pressure source while a second inlet orifice connected to a second said pressure source is blocked, with a second said capsule receiving no signal;

(b) a second period in which both said capsules relax, neither receiving an instruction signal, while said movable element of said pressure divider remains in position;

(c) a third period during which the sensor emits said information signal transmitted to said control element and said control element emits a control signal transmitted to said second capsule whose function is to displace said movable element of said pressure divider in a reverse direction on a path determined by information delivered by said sensor in order to obtain an appropriate mixture of pressures from said first and second pressure sources supplying said control pressure of said valve corresponding to requirements of the room, with the first capsule receiving no signal; and (d) a fourth period, whose duration is over 50% of the duration of the entire cycle, in which both capsules relax, neither receiving an instruction signal, so that said movable element of said pressure divider remains in the same position as in the previous period.

12. A device according to claim 1, wherein said cycle has a total duration of several minutes and comprises the following three periods of which the second and third periods repeat:

(a) a fist period during which said control element emits an instruction signal transmitted to a first said capsule whose function is to displace said movable element of said pressure divider to a position determined by control information emitted by the sensor to establish an output pressure of said valve that is appropriate to a ventilation requirement of the room, while a second said capsule receives no instruction signal;

(b) a second period during which the two capsules relax, neither receiving an instruction signal, while said movable element of said pressure divider remains in position; and (c) a third period during which a value of a signal emitted by the sensor in the room is compared to a value of a preceding sensor signal and (i) if the ventilation requirement is greater, said control element emits an instruction signal transmitted to one said capsule to displace said movable element of said pressure divider such that an inlet orifice connected to a said pressure source which is at a lower pressure communicates more broadly with an outlet orifice to said valve to furnish a said control pressure of said valve that is closer to said lower pressure whereby said bladder is subjected to a pressure closer to said lower pressure, a volume of said bladder decreases, and air flow through said ventilation duct increases, and (ii) if the ventilation requirement is lower, said control element emits an instruction signal transmitted to the other said capsule to cause said movable element of said pressure divider to move in a reverse direction such that an inlet orifice connected to a said pressure source which is at a higher pressure communicates more broadly with said outlet orifice to furnish a said control pressure of said valve that is closer to said higher pressure, whereby said bladder is subjected to a pressure closer to said higher pressure, a volume of said bladder increases, and air flow through said ventilation duct decreases.

13. A device according to claim 1, wherein said cycle comprises:

(a) a first period which starts when said sensor detects a presence of an occupant in the room, while said bladder is at a maximum volume and ventilation flow is minimal, and in which an instruction signal is emitted from the control element and transmitted to a first said capsule to displace the movable element of the pressure divider in a direction such that a first inlet orifice connected to a first said pressure source communicates with an outlet orifice to said valve and a second inlet orifice connected to a second said pressure source is blocked, whereby said bladder is subjected to a said control pressure corresponding to a pressure of said first pressure source and has a minimum volume, which corresponds to a maximum air flow through said ventilation duct, this period continuing for as long as said occupant is detected during a time interval less than a predetermined duration; and (b) a second period which starts when said sensor has not detected a presence of an occupant in the room during said time interval, and in which an instruction signal is emitted from the control element and is transmitted to a second said capsule such that said second inlet orifice connected to said second pressure source communicates with said outlet orifice, while said first inlet orifice is blocked, whereby said bladder is subjected to a said control pressure corresponding to a pressure of said second pressure source and has a maximum volume, which corresponds to a minimum air flow through said ventilation duct, this period continuing for as long as a presence is not detected.

* * * * *